US010526063B2

(12) United States Patent
Taylor

(10) Patent No.: US 10,526,063 B2
(45) Date of Patent: Jan. 7, 2020

(54) OAR WITH OPENINGS IN THE BLADE

(71) Applicant: Oscar Propulsion Ltd., West Sussex (GB)

(72) Inventor: David Graham Taylor, West Sussex (GB)

(73) Assignee: Oscar Propulsion Ltd., West Sussex (GB)

( * ) Notice: Subject to any disclaimer, the term of this patent is extended or adjusted under 35 U.S.C. 154(b) by 0 days.

(21) Appl. No.: 15/568,087

(22) PCT Filed: Apr. 22, 2016

(86) PCT No.: PCT/GB2016/051129
§ 371 (c)(1),
(2) Date: Oct. 20, 2017

(87) PCT Pub. No.: WO2016/170359
PCT Pub. Date: Oct. 27, 2016

(65) Prior Publication Data

US 2018/0141629 A1 May 24, 2018

(30) Foreign Application Priority Data

Apr. 23, 2015 (GB) ..... 1506915.6

(51) Int. Cl.
*B63H 16/04* (2006.01)

(52) U.S. Cl.
CPC ..... *B63H 16/04* (2013.01)

(58) Field of Classification Search
CPC ..... B63H 16/04
See application file for complete search history.

(56) References Cited

U.S. PATENT DOCUMENTS 230,314 A * 7/1880 McManus ..... B63H 16/04 416/74
1,786,451 A * 12/1930 Ribard ..... B63H 16/04 416/231 A (Continued)

FOREIGN PATENT DOCUMENTS

CA 2822282 A1 5/2015
CN 2863641 Y 1/2007

(Continued)

OTHER PUBLICATIONS

Response to Communication filed Jul. 26, 2018 with the EPO ("EPO Response"), including Annexes 1 and 2 showing the results of test data obtained using oars configured in accordance with the presently claimed subject matter (see pp. 16-19 of the Response).

(Continued)

*Primary Examiner* — S. Joseph Morano
*Assistant Examiner* — Jovon E Hayes
(74) *Attorney, Agent, or Firm* — Hall Estill Attorneys at Law

(57) ABSTRACT

Apparatus and method for propelling a watercraft. An oar has a blade and a shaft, the blade having a front side and a back side, the shaft having a longitudinal axis. The blade includes a plurality of openings which pass from the front side to the back side of the blade. In some cases, the openings are slit shaped openings oriented substantially perpendicularly to the longitudinal axis of the shaft. In other cases, the smallest lateral dimension of each opening is 5 mm or less. The openings may influence the flow around the blade so that the blade is more efficient, and thus may produce more useful work in moving a boat than a solid blade with no openings.

22 Claims, 6 Drawing Sheets

(56) References Cited

U.S. PATENT DOCUMENTS

| | | | | |
|---|---|---|---|---|
| 2,543,879 | A | 3/1951 | Stuckey | |
| 3,064,284 | A | 11/1962 | Franklin | |
| 4,493,663 | A | 1/1985 | Richmond | |
| 5,062,816 | A * | 11/1991 | Berglund | A01K 77/00 416/74 |
| 6,210,244 | B1 | 4/2001 | Nordby | |
| 6,254,444 | B1 | 7/2001 | Nordby | |
| 6,796,862 | B1 | 9/2004 | Abbenhouse et al. | |
| 7,850,497 | B2 * | 12/2010 | Kang | B63H 16/04 440/101 |
| 8,066,623 | B2 * | 11/2011 | Tokuma | A63B 21/0084 441/56 |
| 8,632,371 | B1 | 1/2014 | Ramsey | |
| 9,028,287 | B2 * | 5/2015 | Doyle | B63H 16/04 440/101 |
| 2005/0020153 | A1 | 1/2005 | Wilce | |
| 2008/0254691 | A1 | 10/2008 | Scott | |
| 2009/0004935 | A1 | 1/2009 | Branovits | |
| 2010/0056000 | A1 * | 3/2010 | Kang | B63H 16/04 440/101 |
| 2014/0273674 | A1 * | 9/2014 | Doyle | B63H 16/04 440/101 |
| 2018/0141629 | A1 * | 5/2018 | Taylor | B63H 16/04 |

FOREIGN PATENT DOCUMENTS

| | | | |
|---|---|---|---|
| CN | 201457730 | U | 5/2010 |
| CN | 202499270 | U | 10/2012 |
| CN | 203740110 | U | 7/2014 |
| CN | 204170384 | U | 2/2015 |
| CN | 104512540 | A | 4/2015 |
| CN | 204548466 | U | 8/2015 |
| DE | 3817077 | A1 | 12/1988 |
| FR | 2927060 | A1 | 8/2009 |
| GB | 265022 | A | 2/1927 |
| GB | 292080 | A | 8/1929 |
| JP | 592995 | A | 1/1984 |
| JP | 2002104286 | A | 4/2002 |
| JP | 2008189115 | A | 8/2008 |
| WO | 2012066193 | A2 | 5/2012 |

OTHER PUBLICATIONS

Communication Under Rule 71(3) from the European Patent Office (EPO) dated Nov. 5, 2018 ("EPO Grant") indicating that the claims in the EPO application, which are similar to the presently claimed subject matter, have been deemed allowable by the EPO.

* cited by examiner

Schematic to Illustrate Power Developed by Conventional Oar In Direction of Travel

OAR WITH OPENINGS IN THE BLADE

RELATED APPLICATIONS

The present application makes a claim of priority to International Application PCT/GB2016/051129 filed Apr. 22, 2016, which in turn makes a claim of priority to GB Application No. GB1506915.6 filed Apr. 23, 2015.

BACKGROUND

Oars (or paddles) are used to propel watercraft, such as pleasure craft, working boats and racing boats. Oars are devices for converting the efforts of an oarsman into the propulsion of the craft through the water. For the sake of clarity, oars, paddles and any other similar manually operated water propulsion devices are all referred to as "oars" or "oar" in this document.

An oar may typically consist of a blade, a handle which the oarsman holds, and a shaft which connects the handle to the blade. The blade may be shaped like a flattened spoon and the front surface of the blade exerts pressure on the water when the handle is pulled.

The shaft and blade combined are normally substantially longer than the handle. The shaft can rest in a rotating pivot called a rowlock which is attached to the side of the boat. This pivot converts the oar into a lever. The force exerted by the oar on the water may be passed to the boat through the rowlock, causing the boat to accelerate in the opposite direction to the movement of the blade. However, rowlocks are not essential and the boat can be propelled without one, as in the case of a canoe.

Oar designs have changed little since the oars used by the ancient Greeks to power vessels such as triremes 3000 years ago. New materials have been used to make them lighter and stronger, the oar shape has been modified somewhat but otherwise they are substantially the same. In the sport of rowing the shape of the blade has evolved in recent years to make it broader and longer so that it can act on a bigger area of water. This makes the boat go faster but also requires more strength to move the oar through the water.

In competitive rowing, there is always a need for improved designs which make oars more efficient in order to make the boat go much faster for the same effort.

SUMMARY

The present invention is in an improvement to oars which will provide additional power per stroke for the same effort from the oarsman. As a result craft, in particular racing boats, will be able to run faster.

Conventionally, blades are solid in order to press against as large an area of water as possible. It has been surprisingly found that by perforating the blade with various numbers and shapes of openings, the effectiveness of the blade is increased. This means that for a given amount of effort by the oarsman, more force can be transmitted to the boat from the action of the blade passing through the water.

The openings may be round in shape (e.g. holes), or may be elongate (e.g. slot shaped). Alternatively, the openings may be any other shape.

This appears to be counter-intuitive as the area of the blade apparently acting on the water is reduced. One possible explanation for why the perforated blade is more effective is detailed below.

As a normal blade moves through the water it pushes against the water in front of it. This action creates drag on the back surface of the blade as the blade tries to pull away from the water behind. This drag requires energy to overcome it; the oarsman is using the blade both to push against the water in front of the blade and also to pull against the water behind the blade.

It is possible that by perforating the blade, the drag on the back of the blade may be reduced because water can pass through the openings. This water may reduce the backflow behind the blade and increase the pressure difference between the front and back of the blade. Furthermore, vortices are created behind the blade, and the water passing through the openings may help to reduce the size of these vortices, therefore reducing energy wasted in forming the vortices.

Further, the passage of this water through the openings does not greatly reduce the force exerted by the blade because the act of directing the water through the openings requires additional force to be exerted. Effectively, additional force has to be expended to force the water through the openings and to overcome the drag of the water on the sides of the openings. Whilst this additional force compensates for the loss of actual solid area of the blade, it is also more than compensated for by the reduction in effort required to overcome the drag on the back of the blade.

It is generally believed that an oar acts by leveraging against a point in the water: the harder it is to draw the oar through the water, the more leverage is generated in propelling the boat. This is not in fact the full situation; an oar does not operate only like a lever pulling against a fixed point outside the boat, it is more complicated. During each "stroke" the oar sweeps through an arc and some of the force on the water is directed either away from the boat or towards the boat with only a component of this force being usefully employed in propelling the boat. In an idealised stroke, the maximum useful force is generated when the oar is between 70 and 110 degrees to the centre line of the boat.

During the idealised stroke, the propelling component grows to a maximum at the 90 degrees point and then falls away. For the entire stroke the oarsman has to overcome the negative force (suction) on the back of the oar. This is illustrated diagrammatically in FIG. 5.

However, it should be noted that, in a real boat, the maximum power is not necessarily generated when the oar is at 90 degrees to the centre line of the boat. The power distribution may be changed by numerous factors including, but not limited to, the relative movement between the boat and the water, turbulence in the water and other fluid mechanics phenomena, as well as the rower's technique.

According to the present invention, there is provided an oar for a watercraft, the oar comprising a blade and a shaft, the blade having a front side and a back side, and the shaft having a longitudinal axis; wherein the blade includes a plurality of slit shaped openings oriented substantially perpendicularly to the longitudinal axis of the shaft and passing from the front side to the back side. The slit shaped openings may influence the flow around the blade so that the blade is more efficient, and thus produces more useful work in moving a boat than a blade with no slits.

According to another aspect of the present invention, there is provided an oar for a watercraft, the oar comprising a blade and a shaft, the blade having a front side and a back side, and the shaft having a longitudinal axis; wherein the blade includes a plurality of openings passing from the front side to the back side, and wherein the smallest lateral dimension of each opening is 5 mm or less.

According to another aspect of the present invention, there is provided a method of increasing the efficiency of an oar comprising a blade by providing a plurality of openings passing from a front side of the blade to the back side of the blade. This means that a larger amount of useful work can be transmitted from an oarsman to a boat, which can result in the boat moving faster for a given input of work from the oarsman.

The size of the openings is designed to be comparable to, or less than, the size of the boundary layer of water in typical conditions (e.g. ambient temperature, pressure, flow velocity) in which rowing takes place. This means that the opening can be effectively "blocked" by the interaction of the boundary layers of the fluid flowing through it. Optionally each opening may be a circular hole. Optionally each opening may be slit shaped. Optionally each opening may be a square hole. Each opening may also be of any other suitable shape, such as another type of quadrilateral, curved shape or any combination of shapes. Other examples of suitable shapes are oval shapes, star shapes or "cookie cutter" (i.e. generally round but with a serrated edge) shapes.

Various optional or preferable features will now be mentioned that can be applied to any of the above aspects of the invention. The "depth" of the openings refers to the direction of the blade thickness (i.e. through the blade from the front side to the back side). The "width" and "length" of the openings are directions in the same plane as the surface of the front side and back side of the blade.

Preferably the plurality of openings are spaced evenly in a direction parallel to the longitudinal axis along the blade. Alternatively, the openings may also have variable spacing. For example, the spacing of the slit shaped openings may vary such that the slit shaped openings are closer together further from the shaft.

Preferably the plurality of openings are spaced such that the distance between each opening is larger than the width of each slit. Alternatively, the distance between each opening may be equal to the width of each opening, or smaller than the width of each opening.

Preferably the width of each opening is 0.1 mm-10 mm.

Preferably the width of each opening is 0.3 mm-3 mm.

Preferably the width of each opening is 0.4 to 1.4 mm, more preferably substantially 0.5 mm or 1 mm. The width of each opening may be of any other suitable size, such as 0.1 mm-1 mm, 0.2 mm-2 mm, or 0.5 mm-1.5 mm.

Preferably the total area of the plurality of openings is greater than 0.2% and less than 10% of the total area of the front side or back side. The total area may also be between 0.1% and 20% of the total area of the front side or back side.

Preferably the blade includes 10 or more openings. The blade may also include 5 or more, 15 or more, 20 or more, or 30 or more openings.

Optionally the cross-section of the openings changes through the thickness of the blade. Each opening may pass from the front side to the back side in a direction substantially perpendicular to the surface of at least one of the front side and the back side. Alternatively, each opening may pass from the front side to the back side at an angle of between 30 degrees and 60 degrees to at least one of the front side and the back side, and preferably at an angle of 45 degrees.

Preferably the ratio of the length of each opening to the width of each opening is at least 100:1, more preferably at least 400:1. The ratio of the length of each opening to the width of each opening may also be at least 200:1, 300:1 or 500:1. These ratios are suitable for slit shaped openings. Such a ratio may not be relevant for square and circular hole shaped openings.

Preferably the length of each opening is at least 50% of the width of the blade. The length of each opening may also be at least 25%, at least 40%, at least 60% or at least 80% of the width of the blade.

BRIEF DESCRIPTION OF THE DRAWINGS

The present invention will now be described by way of example only with reference to the following drawings.

DETAILED DISCUSSION

An oar for a boat will now be described with reference to FIGS. 1-6B. The oar 10 may comprise a shaft 20 and a blade 30. The blade may have a front side and a back side. The front side is the side of the blade which pushes against the water when the boat is being rowed. In a conventional rowing boat, the rower faces backwards relative to the direction of movement of the boat, meaning that the front side of the blade 30 also faces backwards relative to the direction of movement of the boat.

The shaft may have a circular cross section, and may be cylindrical, tapered or cone shaped. However, the shape of the shaft is not limited to having a circular cross sections and may take any suitable shape.

The shape of the blade may be an oval, as shown in FIGS. 1-4. However, many other suitable shapes for blades are well known in the art, such as "Macon" (spoon), or "Cleaver" shapes. The blade may also have any other suitable shape, such as a rectangular shape, a square shape, a triangular shape, or a circular shape.

Figure 1:
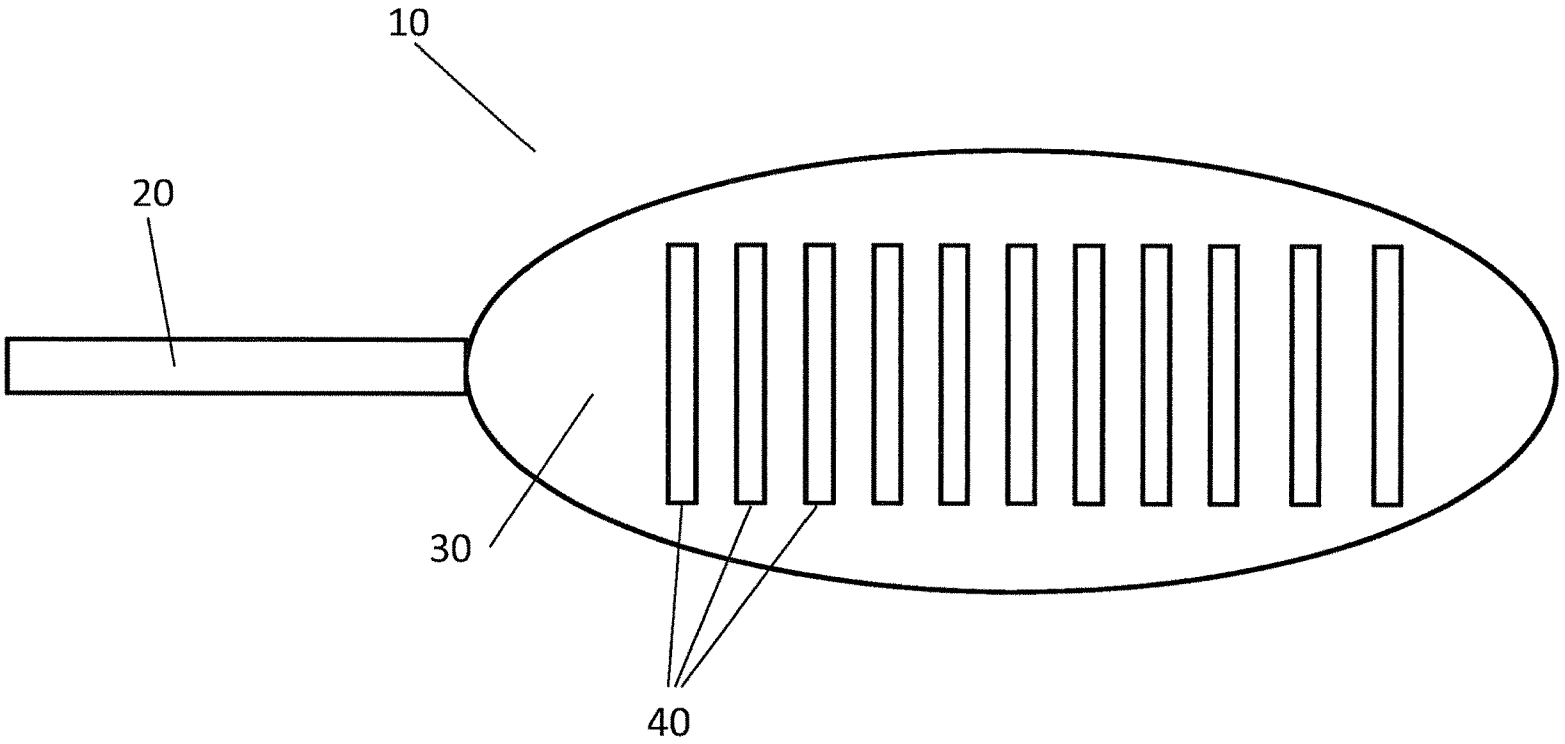
FIG. 1 is a plan view of an oar for a boat including a plurality of slit shaped openings according to the present invention.

The blade 30 may include a plurality of slit shaped openings 40, passing from the front side to the back side of the blade. In other words, slots may be cut in the blade. As shown in FIG. 1, the slit shaped openings 40 may have a rectangular shape. This provides for a comb-like structure with the outer edges of the blade providing strength.

The width of the slit shaped openings 40 (i.e. in the direction parallel to the longitudinal axis of the blade) may be between 0.1 mm and 50 mm, preferably between 0.2 mm and 10 mm, more preferably between 0.3 mm and 5 mm, and most preferably 0.5 mm or 1 mm. However, the dimensions of the slit shaped openings is not limited, and their shape is not necessarily a rectangle. The slit shaped openings may have curved edges, or be of any other suitable shape.

CFD studies modelling the performance of a blade with slit shaped openings as outlined above have been carried out using a 3D dynamic model of a blade measuring 25 cm by 50 cm. These dimensions were chosen to resemble those of a typical rowing blade. The model blade had 33 slit shaped openings of 1 mm width. These studies indicated that an increase in force of up to 10% may be obtained for a blade with slit shaped openings compared to a solid blade. Further studies using CFD indicated that slit shaped openings of 0.5 mm width, separated by "fingers" of blade material 1 cm or 1.5 cm wide, also gave favourable results.

Figure 2:
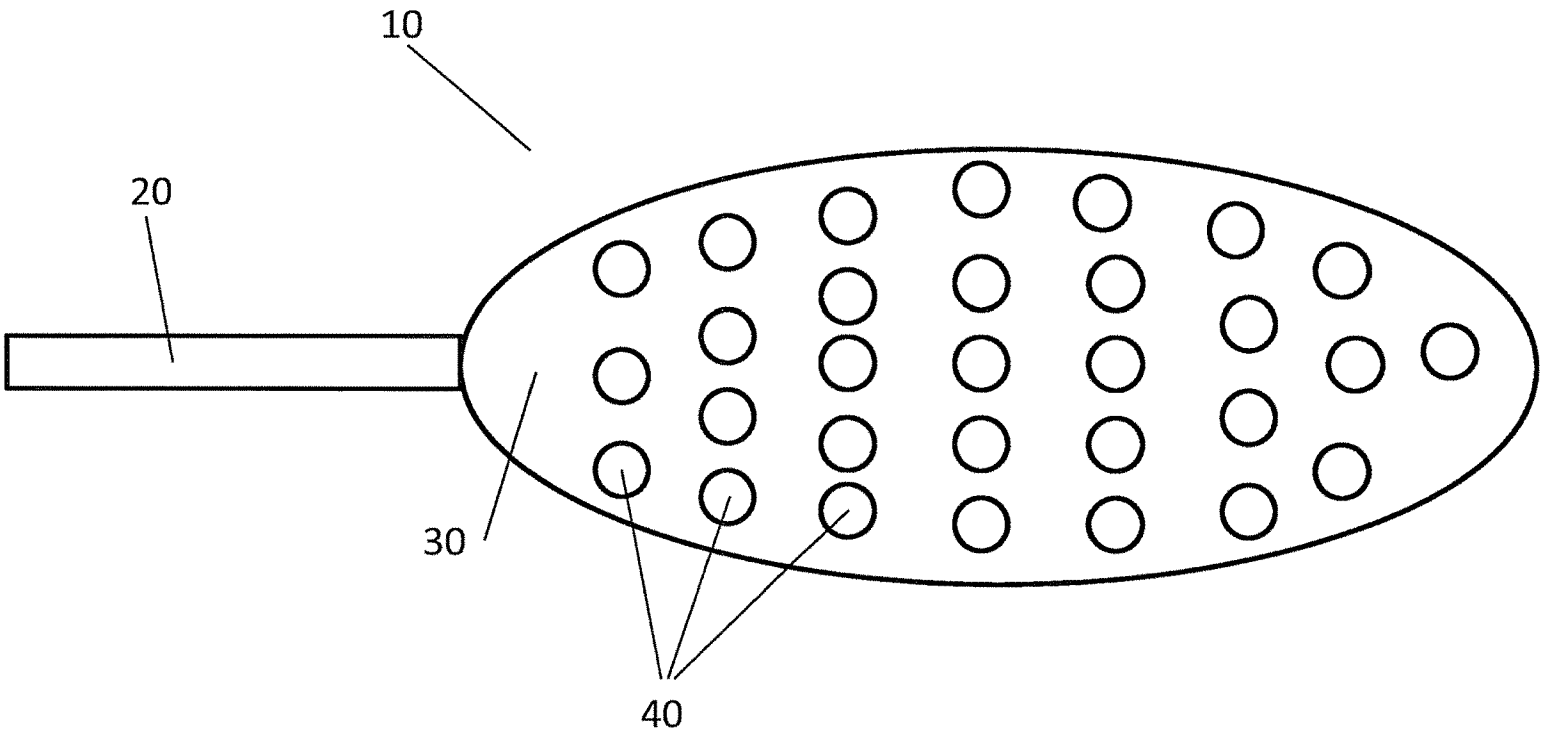
FIG. 2 is a plan view of an oar for a boat including a plurality of circular hole shaped openings.

In the embodiment shown in FIG. 1, the openings are slit shaped. However, the openings are not limited to being slit shaped, and may be formed in any other suitable shape. For example, FIG. 2 illustrates a blade with circular openings 40. Alternatively, the slit shaped openings may be divided into multiple shorter openings along the line of the slit, giving an appearance of a "dotted" or "dashed" line. Such an arrangement can be considered either as a long slit with small breaks, or as a number of small openings arranged in a line to resemble a slit.

The openings can be of any shape, size or pattern of distribution over the area of the blade. For example, the openings could run parallel to the longitudinal axis of the shaft or at angles between parallel and 90 degrees to the longitudinal axis of the shaft. The openings can also be arranged so that they "fan out" from a point on the blade such as one end of the blade. The openings may also be of any other suitable shape, such as another type of quadrilateral, curved shape or any combination of shapes. Other examples of suitable shapes are oval shapes, star shapes or "cookie cutter" (i.e. generally round but with a serrated edge) shapes, or combinations thereof.

Figure 3:
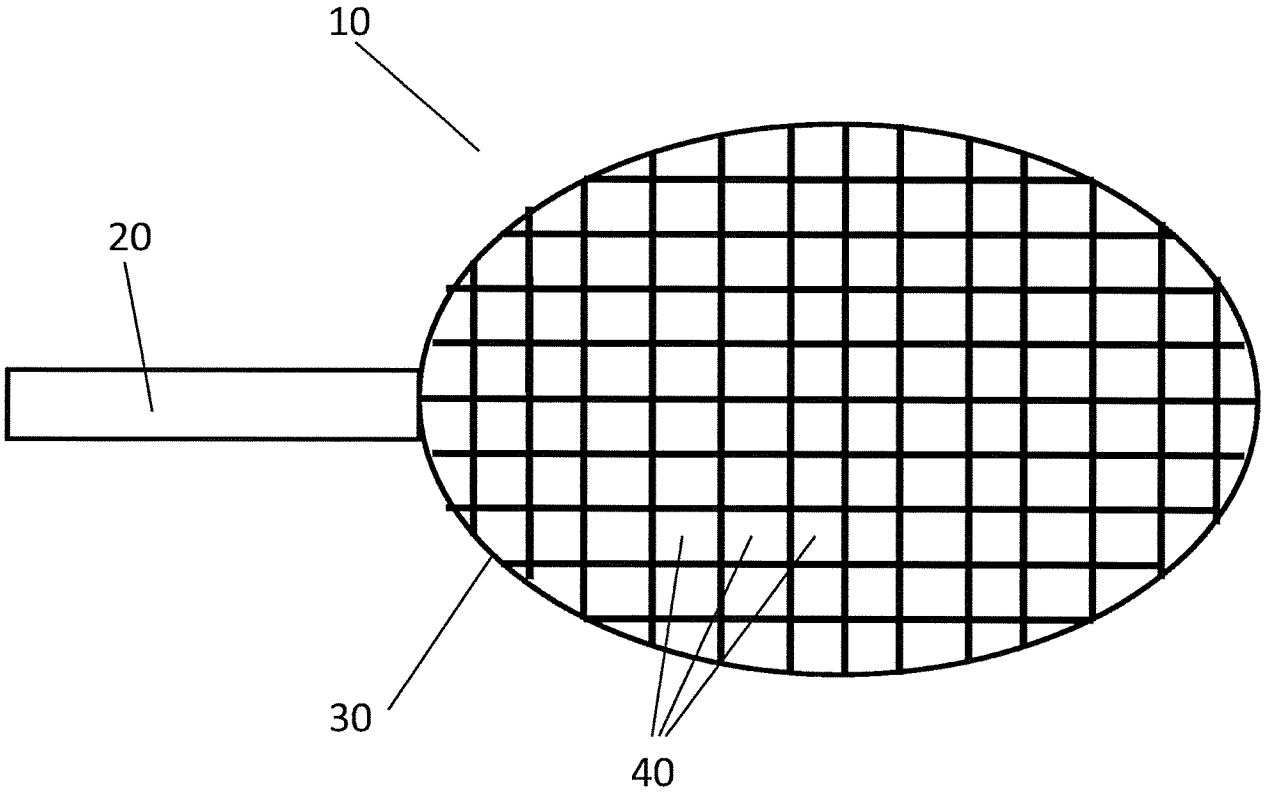
FIG. 3 is a plan view of an oar for a boat including a plurality of square hole shaped openings.

Alternatively, the solid pieces of blade could be arranged to achieve a lattice with square shaped holes 40, as shown in FIG. 3, and various patterns and spacings could be used within the lattice to achieve the best effect.

The openings do not need to be uniform in their cross section along their length or depth and can, for example, be wider on one surface of the blade than the other. For example, a circular hole may be cone shaped, or a slit shaped opening may have a wedge shape.

Figure 6B:
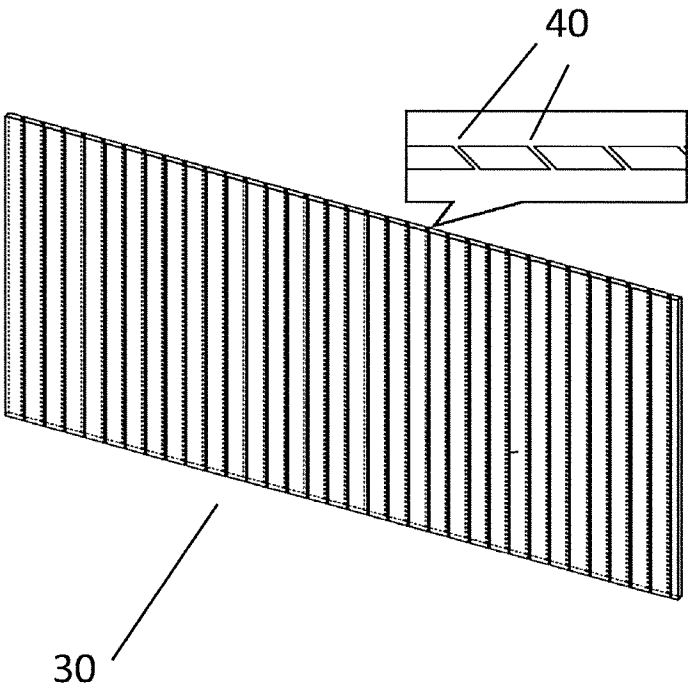
FIG. 6*b* schematically shows a blade with openings angled at 45 degrees through the thickness of the blade.
Figure 6A:
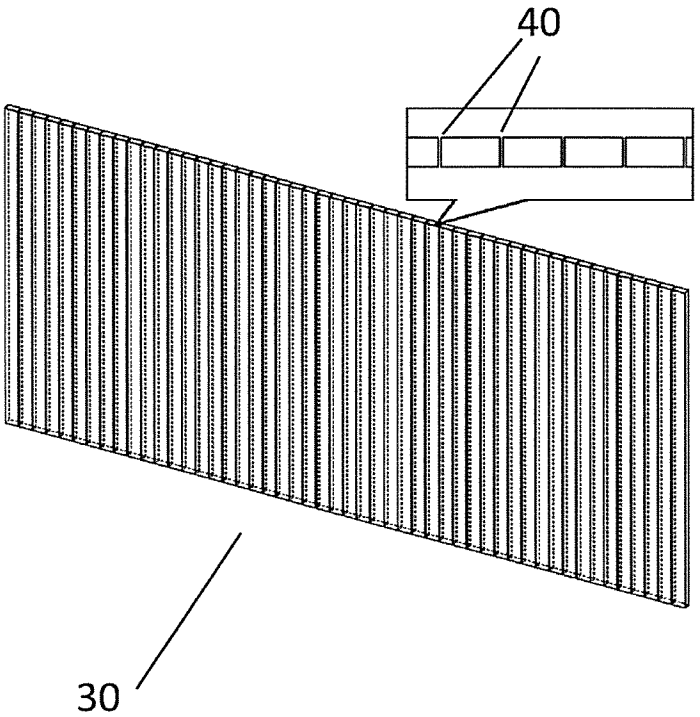
FIG. 6*a* schematically shows a blade with openings perpendicular through the thickness of the blade.

The openings may also not pass directly through the blade but can take indirect pathways through the blade. For example, rather than passing through the blade from the front side to the back side (i.e. through the thickness of the blade) perpendicularly to the surface of the blade (as shown in FIG. 6*a*), the openings 40 may be angled, as shown in FIG. 6*b*. CFD studies have shown that openings angled at 45 degrees, as shown in FIG. 6*b*, can deliver a higher driving force than openings which pass through the blade perpendicular to the surfaces of the blade. Other angles, for example between 30 degrees and 60 degrees, may also be suitable. Furthermore, the openings do not have to pass through the blade at a constant angle. Instead, they may change in angle partway through the thickness of the blade. For example, the openings may form a "zigzag" shape, or any other shape, through the thickness of the blade.

The blade itself can be constructed in other ways to the conventional blades. For example, it may be thicker in cross section so that the openings can be deeper.

The solid areas between the openings can have any shape and spacing. They could for example be oval, round or rectangular in cross section. There could be a mixture of shapes with the solid areas between the openings having different shapes in their depths. They could also, for example, be streamlined in their depth so that the solid areas themselves are designed to reduce drag on their dorsal ends through eliminating negative pressure that would be created by a non streamlined shape, whilst at the same time generating useful drag between adjacent solid parts and the water.

The blade could comprise one or more layers of such openings so that the water, having passed through one perforated surface, has to pass through more such perforated surfaces. This complicated flow of water may generate more useful drag against the water whilst increasing the force applied to the water.

The size and spacing of the openings is an important consideration. In CFD simulations, it has been found that, if the openings are narrow, the force that can be applied to the water increases. This may be because the openings increase the effective width of the blade. What is meant by the term "narrow" is the width for which the boundary layers at the sides of the openings interact, generating resistance to the flow of water and effectively acting as solid areas. This is particularly the case where the openings is small or where the opening is a narrow slit.

One possible explanation for the increase in force is that the friction of the water on an opening's internal surfaces and the force of the water that is diverted through the opening generate resistance and hence additional force on the blade. This resistance may compensate for the lack of solid blade material in the area of the opening. The oarsman in this situation can apply more force on the water because the effective size of the blade is bigger.

Once the openings are big enough that the boundary layers at the sides of the openings do not interact, the force on the blade may decline ultimately to that of the combined forces acting on the individual elements of the blade, between the openings. However, it has been observed that the force that needs to be applied to the oar decreases much faster than the drop off in force on the blade. This may be because of the reduction in the suction at the back of the blade owing the flow of water through the blade. The oarsman may achieve more useful propulsive force in this situation than if the blade were solid and even if the blade had openings where the boundary layers interact.

Providing additional openings in the blade may lead to an increase in width which, if taken to the extreme, may make the blade unmanageable. Preferably the blade should retain similar overall dimensions to a conventional blade. This can be achieved because a blade with openings may generate disproportionately more force on the water for the same effort by the oarsman, for a given increase in width due to the openings than from the same increase in width without openings.

Similarly, a blade with openings may generate a larger useful force applied to the water for a given effort by the oarsman with no increase in width over a standard blade size, or even with a smaller blade width.

Taken to the extreme, the force on the water can be generated by a comparatively thin blade which comprises multiple elements whose width is greater than their thickness. The elements may be orientated so that their thin edge is directed in the direction of the oar sweep. The force on the water may then be generated by the friction of the water over the surface of the elements. There is very little suction in this situation. The elements can be further streamlined. An example of a blade using this arrangement is shown in FIG. 3.

Figure 4:
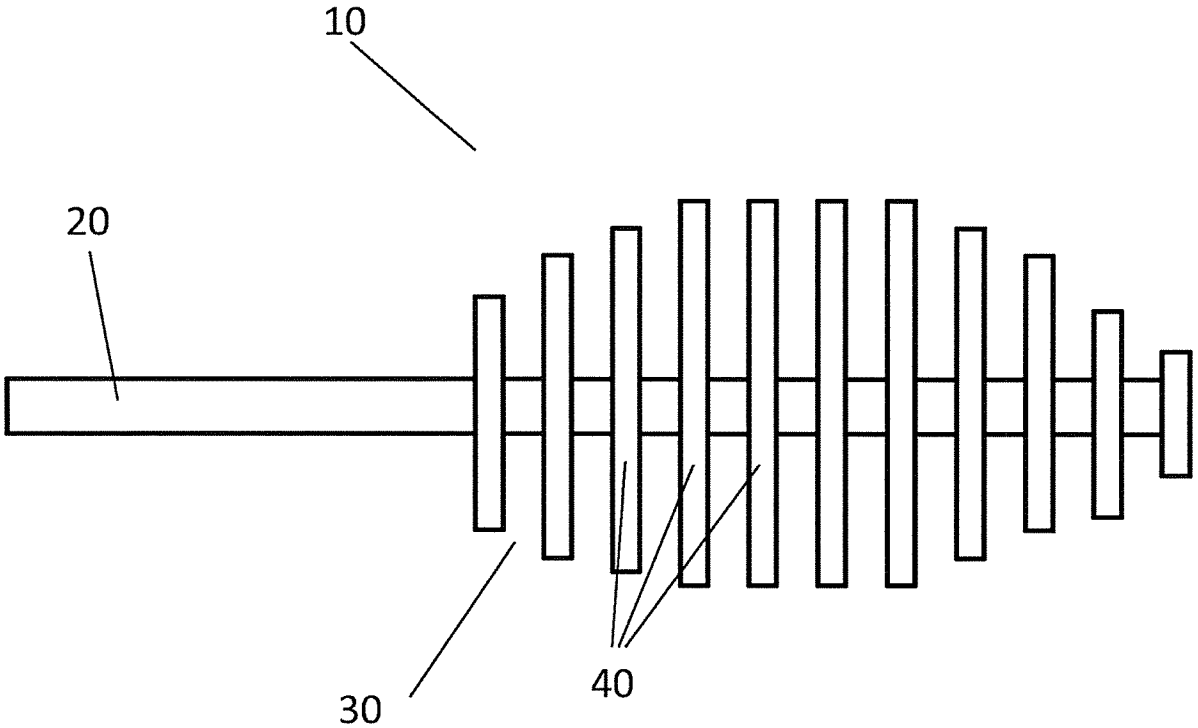
FIG. 4 is a plan view of an oar for a boat including a plurality of slit shaped openings.
Figure 5:
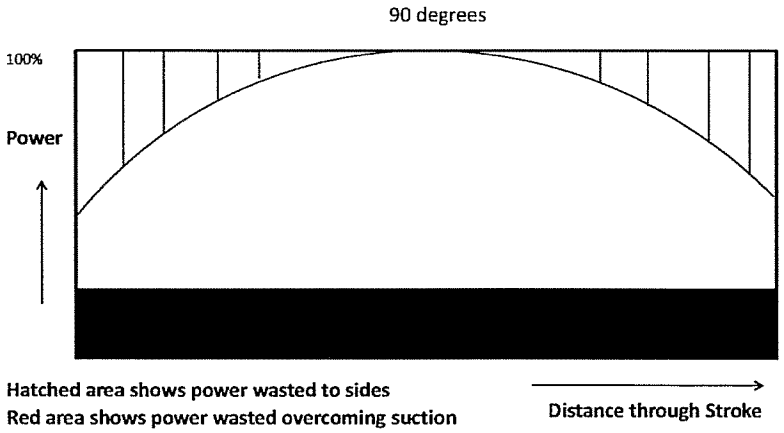
FIG. 5 is a diagram showing the power generated during an idealised rowing stroke.

It is important that the blade should be robust to reduce the risk of damage should the blade make contact with a hard object, such as a blade from a competitor's boat, during racing. To this end it is preferable that the periphery of the blade should be solid to give it strength against this sort of impact. However it is possible for the edges to be open (as shown in FIG. 4).

A trial was conducted using a small rowing boat on a 30 m swimming pool. Two prototype oars with perforated blades of the type shown in FIG. 3 were used. An oarsman was seated in the boat and instructed to row as hard as he could to the other end of the pool. The number of strokes used to reach the end of the pool was recorded. The oarsman then changed the oars to ones which had the same dimensions but had no perforations and repeated the exercise. Again the number of strokes was recorded. He then rested for 5 minutes and the exercise was repeated six times using the two different designs.

The following data in Table 1 was recorded which shows that the perforated blade was more efficient than the solid blade.

TABLE 1

| Run number | | Strokes (average) Perforated | Strokes (average) Solid |
|---|---|---|---|
| 1 | Perforated | 37 | |
| 2 | Solid | | 44 |
| 3 | Perforated | 38 | |
| 4 | Solid | | 46 |
| 5 | Perforated | 36 | |
| 6 | Solid | | 45 |
| 7 | Perforated | 37 | |
| 8 | Solid | | 46 |
| 9 | Perforated | 35 | |
| 10 | Solid | | 47 |
| 11 | Perforated | 38 | |
| 12 | Solid | | 46 |
| Average Strokes | | 36.83 | 45.67 |

The above description relates to oars, or paddles, for boats. It should also be noted that other forms of marine propulsion such as fins used by divers operate in much the same way as oars, and the principles of this patent application may apply equally to improvements in these.

The invention claimed is:

1. An oar for a watercraft, the oar comprising a blade and a shaft, the blade having a front side and a back side, and the shaft having a longitudinal axis, wherein the blade includes a plurality of slit shaped openings oriented substantially perpendicularly to the longitudinal axis of the shaft and passing from the front side to the back side, wherein the openings are disposed at different respective distances from a distal end of the blade opposite the shaft.

2. The oar according to claim 1, wherein the plurality of slit shaped openings are spaced evenly in a direction parallel to the longitudinal axis along the blade.

3. The oar according to claim 1, wherein the spacing of the slit shaped openings varies such that the slit shaped openings are closer together further from the shaft.

4. The oar according to claim 1, wherein the plurality of slit shaped openings are spaced such that the distance between each opening is larger than the width of each slit.

5. The oar according to claim 1, wherein the ratio of the length of each slit shaped opening to the width of each slit shaped opening is at least 100:1.

6. The oar according to claim 1, wherein the length of each slit shaped opening is at least 50% of the width of the blade.

7. The oar according to claim 1, wherein the width of each opening is from nominally 0.1 mm to nominally 10 mm.

8. The oar according to claim 1, wherein the width of each opening is a selected one of nominally 0.5 mm or nominally 1.0 mm.

9. The oar according to claim 1, wherein the total area of the plurality of openings is greater than 0.2% and less than 10% of the total area of the front side or back side.

10. The oar according to claim 1, wherein the blade includes at least 10 openings.

11. The oar according to claim 1, wherein the cross-section of the openings changes through the thickness of the blade.

12. The oar according to claim 1, wherein each opening passes from the front side to the back side in a direction substantially perpendicular to the surface of at least one of the front side or the back side.

13. The oar according to claim 1, wherein each opening passes from the front side to the back side at an angle of between about 30 degrees to about 60 degrees.

14. A method of increasing the efficiency of an oar having a shaft and a blade comprising providing a plurality of openings that pass from a front side of the blade to a back side of the blade, the openings comprising a plurality of slit shaped openings oriented substantially perpendicularly to and distributed along a longitudinal axis of the shaft, wherein the openings are disposed at different respective distances from a distal end of the blade opposite the shaft.

15. The method according to claim 14, wherein the spacing of the openings varies such that the slit shaped openings are closer together further from the shaft.

16. The method according to claim 14, wherein the width of each opening is from nominally 0.1 mm to nominally 10 mm.

17. The method according to claim 14, wherein the width of each opening is a selected one of nominally 0.5 mm or nominally 1.0 mm.

18. The method according to claim 14, wherein the total area of the plurality of openings is greater than 0.2% and less than 10% of the total area of the front side or the back side.

19. The method according to claim 14, wherein the blade includes at least 10 openings.

20. The method according to claim 14, wherein the cross-section of the openings changes through the thickness of the blade.

21. The method according to claim 14, wherein each opening passes from the front side to the back side in a direction substantially perpendicular to the surface of at least one of the front side or the back side.

22. The method according to claim 14, wherein each opening passes from the front side to the back side at an angle of from between about 30 degrees to about 60 degrees.

* * * * *